US005195734A

United States Patent [19]

Tanabe

[11] Patent Number: 5,195,734

[45] Date of Patent: Mar. 23, 1993

[54] SHEET FEEDING DEVICE FOR IMAGE FORMING EQUIPMENT

[75] Inventor: Hiroshi Tanabe, Yokohama, Japan

[73] Assignee: Ricoh Company, Ltd., Tokyo, Japan

[21] Appl. No.: 751,063

[22] Filed: Aug. 28, 1991

[30] Foreign Application Priority Data

Aug. 31, 1990 [JP] Japan ..... 2-228175
Oct. 25, 1990 [JP] Japan ..... 2-285826

[51] Int. Cl.[5] ..... B65H 5/26

[52] U.S. Cl. ..... 271/9; 271/164; 271/171; 414/798.8

[58] Field of Search ..... 271/9, 145, 171, 162, 271/164; 414/798.8

[56] References Cited

U.S. PATENT DOCUMENTS 5,102,112 4/1992 Takahashi ..... 271/164

FOREIGN PATENT DOCUMENTS 0009646 1/1982 Japan ..... 271/9
0188336 8/1986 Japan .

*Primary Examiner*—H. Grant Skaggs
*Assistant Examiner*—Carol Lynn Druzbick
*Attorney, Agent, or Firm*—Oblon, Spivak, McClelland, Maier & Neustadt

[57] ABSTRACT

A sheet feeding device for a copier, facsimile transceiver, printer or similar image forming equipment has a first tray and a second tray each being capable of accommodating part of a great amount of sheets and, therefore, has a thin configuration. The first tray can be pulled out along guide rails together with the first tray, facilitating the continuous supplement and feed of sheets.

21 Claims, 16 Drawing Sheets

| FIG. 6A |
| --- |
| FIG. 6B |

| FIG. 10A |
| --- |
| FIG. 10B |

SHEET FEEDING DEVICE FOR IMAGE FORMING EQUIPMENT

BACKGROUND OF THE INVENTION

The present invention relates to a sheet feeding device for a copier, facsimile transceiver, printer or similar image forming equipment.

A sheet feeding device capable of accommodating a great amount of sheets at a time has been proposed in various forms in the past. For example, Japanese Utility Model Laid-Open Publication No. 182748/1982 discloses a sheet feeding device to be loaded with a single stack of sheets. Japanese Patent Laid-Open Publication No. 33638/1974 proposes a device elaborated for supplementing sheets. Further, Japanese Patent Publication Nos. 58090/1989 and 58091/1989 each teaches a sheet shifting device which is so constructed and arranged as to accommodate a great amount of sheets in two stacks to thereby reduce the overall thickness thereof.

A drawback with the device disclosed in the above-mentioned Japanese Utility Model Laid-Open Publication is that the vertical dimension thereof has to be great enough to accommodate a great amount of sheets in a single stack. This kind of device, therefore, cannot be incorporated in an equipment body and needs an extra and substantial space for installation at the side of the equipment body. Another drawback is that to supplement sheets the operator has to interrupt the sheet feeding operation of the device and then lower an elevator tray to obtain a space for a supplement, i.e., the device cannot effect continuous sheet feed and lacks in productivity. The devices taught in the above-mentioned Japanese Patent Laid-Open Publication and Patent Publications each shifts, when one of two stacks of sheets is fully fed out, the other stack of sheets in an intended direction of sheet feed to allow the operator to place another stack of sheets in the unoccupied space. Such a device can effect continuous sheet feed and, therefore, enhances productivity. However, since this kind of device implements a support for loading a sheet stack as belts, pressing mean or similar sheet shifting means mounted on an equipment body, the operator intending to set a sheet stack in the device has to insert it as far as the sheet shifting means, resulting in troublesome and inefficient sheet supply.

SUMMARY OF THE INVENTION

It is, therefore, an object of the present invention to provide a sheet feeding device for image forming equipment which is thin, easy to supply a supplementary stack of sheets, and capable of feeding a great number of sheets.

It is another object of the present invention to provide a generally improved sheet feeding device for image forming equipment.

In accordance with the present invention, a sheet feeding device for image forming equipment comprises a first storing section for stacking a plurality of sheets, a feeding section for feeding sheets one by one from the first storing section, a second storing section positioned horizontally and parallel to the first storing section, a shifting arrangement for shifting sheets collectively from the second storing section to the first storing section, and guide members for guiding the second storing section such that the second storing section may be pulled out in a direction substantially perpendicular to an intended direction of sheet shift.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 18:
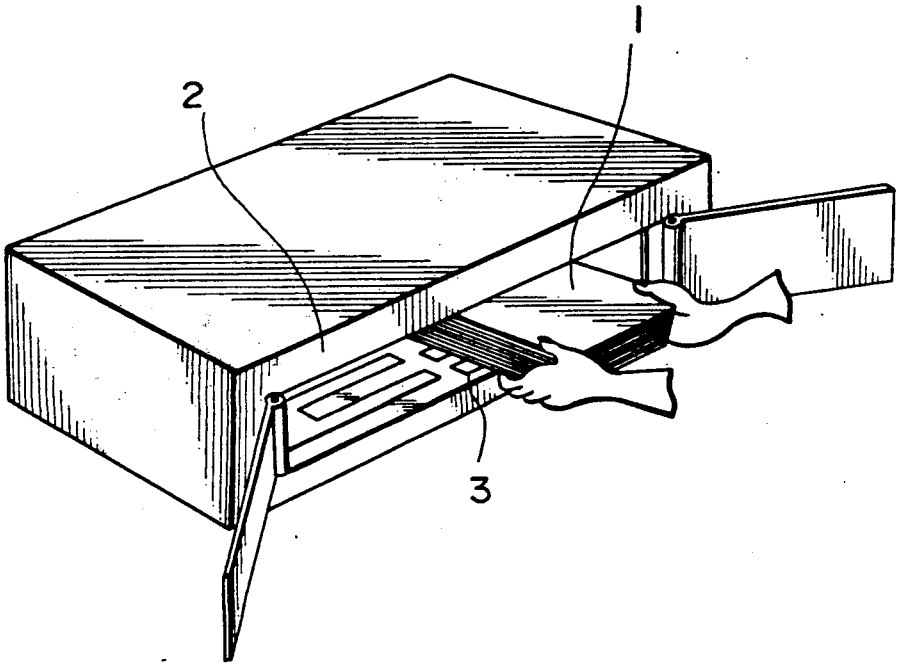
FIG. 18 PRIOR ART
FIG. 18 is a perspective view showing how a supplementary sheet stack is set in a conventional sheet feeding device.

To better understand the present invention, a brief reference will be made to a prior art sheet feeding device for image forming equipment, shown in FIG. 18. As shown, the sheet feeding device has a casing 2 in which a space for setting two stacks of sheets 1 side by side is available. When all the sheets 1 constituting one of the stacks are fed out, the other stack of sheets 1 is transported to the space having been occupied by the first-mentioned sheet stack by belts 3 or similar shifting means. The prerequisite with such a conventional device is that a supplementary sheet stack 1 inserted into the casing 2 by the operator be surely laid at least on the belts 3. The operator, therefore, has to supply or set a sheet stack in the casing 2 with care.

Figure 1:
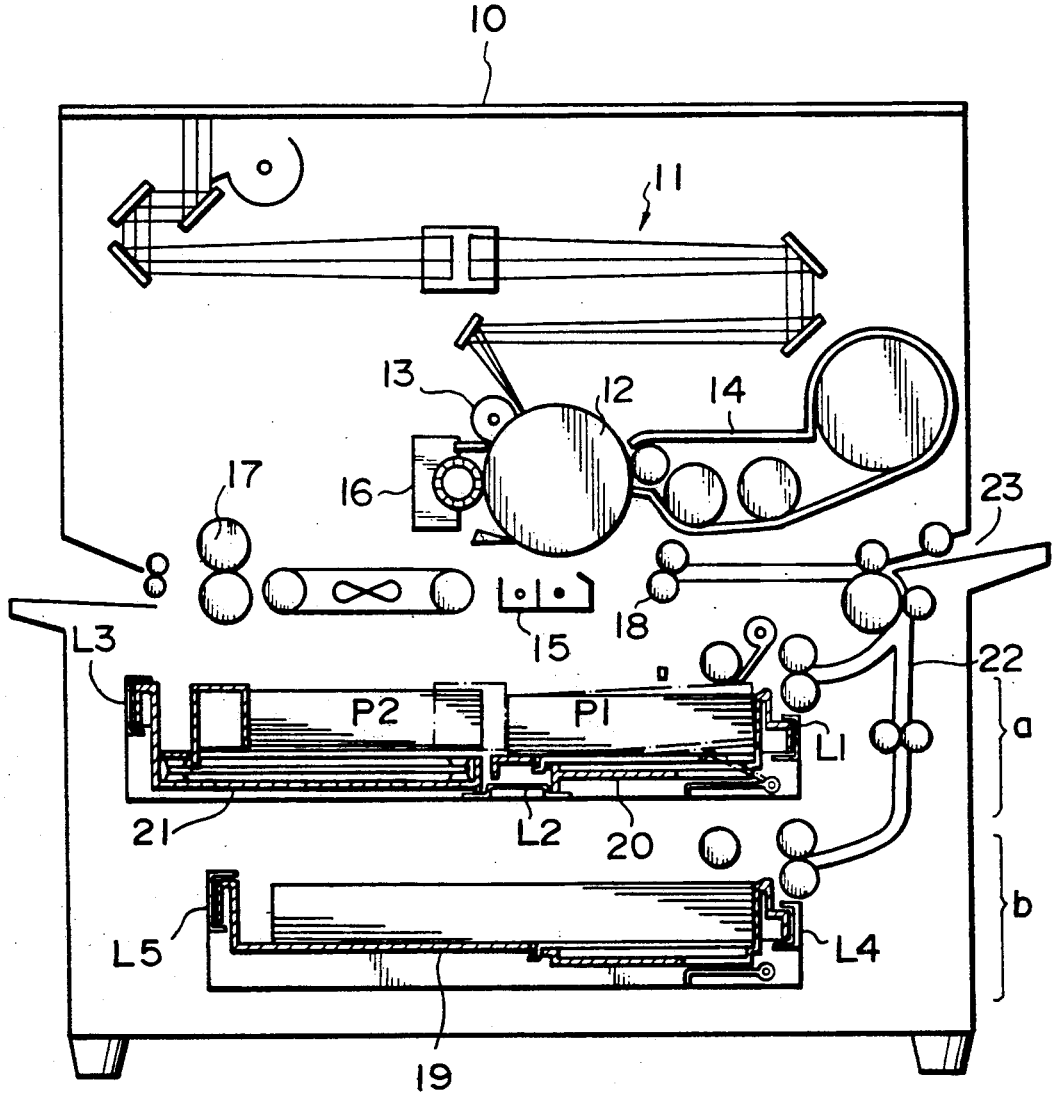
FIG. 1 is a view of a copier to which a sheet feeding device in accordance with the present invention is applied.

Preferred embodiments of the present invention will be described hereinafter. Generally, as shown in FIG. 1, a sheet feeding section for practicing the embodiments to be described has an upper feed stage a and a lower feed stage b. A sheet feeding device in accordance with the present invention is disposed in the upper feed stage a, while a conventional tray accommodating sheets of relatively large size such as A3 is disposed in the lower feed stage b. Both of the device of the present invention and the conventional tray can be pulled out in a direction perpendicular to the sheet surface of FIG. 1, as needed.

FIG. 1 shows a copier to which a preferred embodiment of the sheet feeding section in accordance with the present invention is applied. The copier has a glass platen 10 for laying a document thereon, optics 11 for illuminating the document to expose a photoconductive drum 12, a charger 13, a developing unit 14, an image transfer and sheet separating unit 15, a cleaning unit 16, a fixing unit 17, and a register roller pair 18. A large tray 19 is loaded with sheets of relatively large size. A first and a second sheet storing section 20 and 21, respectively, are arranged horizontally and parallel to each other. Guide rails L1, L2 and L3 guide associated one of the first and second sheet storing sections 20 and 21 when the latter is pulled out of the copier. Transport means 22 transports a sheet selectively fed out of the tray 19 or the first storing section 20 to the register roller pair 18. A sheet may be manually inserted into the copier through a slot 23, as desired. Guide rails L4 and L5 guide the large tray 19 when the latter is pulled out of the copier. The first and second storing sections 20 and 21 each has a box-like configuration which is open at one end thereof where it faces the other storing section. Paper sheets stacked on the second storing section 21 can be bodily moved to the first storing section 20 via the aligned open ends of the storing sections 21 and 20, as will be described.

Figure 2:
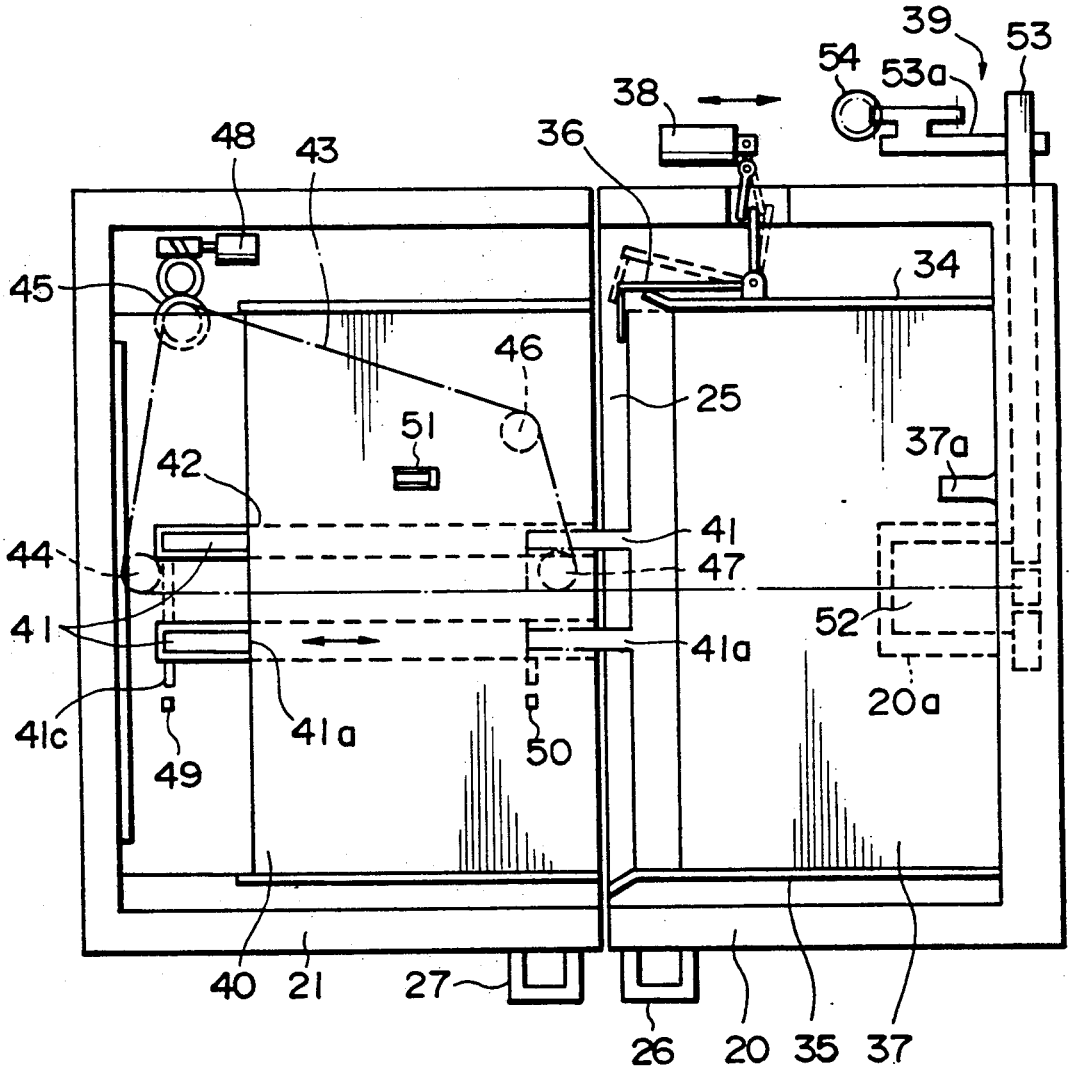
FIG. 2 is fragmentary plan view of the embodiment.
Figure 3:
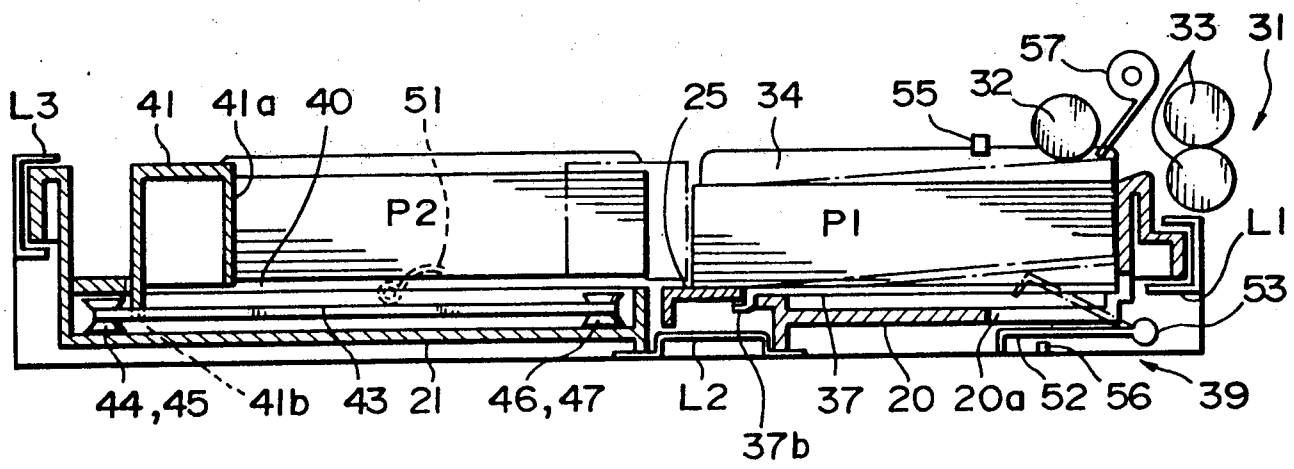
FIG. 3 is a front view associated with FIG. 2.

Referring also to FIGS. 2 and 3, there is shown a shift path 25 intervening between the first and second storing sections, or trays, 20 and 21 to allow a sheet stack P2 to be shifted from the tray 21 to the tray 20. Knobs 26 and 27 are provided on the first and second trays 20 and 21, respectively. The guides L1, L2 and L3 each extends in a direction substantially perpendicular to the direction for shifting the sheet stack P2. Sheet feed means 31 is implemented by a pick-up roller 32 and a separation roller pair 33. The reference numerals 34 and 35 designate a pair of side fences while the reference numeral 36 designates a back fence. A bottom plate 37 is engaged with the first tray 20 at one end 37*b* thereof to be rotatable, i.e., elevatable. A solenoid 38 is associated with the back fence 36 to cause the latter to retract from the shift path 25, as needed. Elevating means 39 which will be described drives the bottom plate 37. A bottom plate 40 is affixed to the second tray 21. A movable back fence 41 moves the whole sheet stack P2 from the second tray 21 to the first tray 20 by pressing substantially the center of the rear end of the sheet stack P2. Slots 42 are formed through the bottom plate 40 to allow the pressing portions 41*a* of the back fence 41 to move therealong. A wire 43 is passed over pulleys 44–47 and the lower end 41*b* of one of the pressing portions 41*a* of the back fence 41. The wire 43 may be replaced with a timing belt, if desired. A reversible motor 48 reversibly rotates the pulley 45 over which the wire 43 is passed. A home position sensor 49 and a positioning sensor 50 are responsive to the movement of a lug 41*c* extending from the back fence 41. A sheet sensor 51 is responsive to the sheets P2 stacked on the bottom plate 40.

Figure 4:
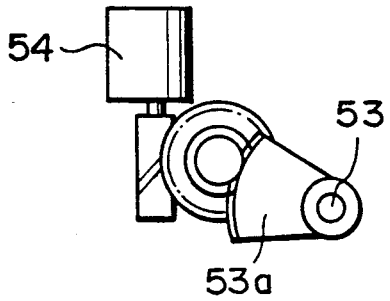
FIG. 4 is a fragmentary view of a drive section included in elevating means which forms part of the embodiment.

FIG. 4 shows a drive section included in the elevating means specifically. As shown in FIGS. 2, 3 and 4, a presser plate 52 is movable into contact with the bottom plate 37 at one end thereof via an opening 20*a* which is formed through the first tray 20. The other end of the pressure plate 52 is supported by a shaft 53. A reversible motor 54 reversibly drives a sector gear 53*a* which is mounted on one end of the shaft 53. A limit switch 55 defines the upper limit of the position of uppermost one of the sheets P1 stacked on the bottom plate 37. A down sensor 56 is responsive to the downward movement of the presser plate 52 to a position where it does not contact the bottom plate 37. An empty sensor 57 is responsive to the sheets P1 stacked on the first tray 20.

Since a copying process to be effected in the vicinity of the drum 12 is well known in the art, the following description will concentrate on the feed of sheets from the first and second trays 20 and 21.

The sheets P1 stacked on the first tray 20 are sequentially fed out one by one by the pick-up roller 32 and separation roller pair 33. While the pick-up roller 32 is in operation, the reversible motor 54 rotates the presser plate 52 via the sector gear 53*a* and shaft 53 to thereby cause the bottom plate 37 to press the sheets P1 upward. The elevation of the sheets P1 is regulated in response to the output of the limit switch 55. As soon as the first tray 20 runs out of the sheets P1, the empty sensor 57 falls into a notch 37*a* formed in the bottom plate 37 to indicate such an occurrence.

To shift the sheets P2 from the second tray 21 to the first tray 20, the reversible motor 48 moves the wire 43 passed over the pulleys 44–47 for thereby moving the back fence 41. Specifically, the pressing portions 41*a* of the back fence 41 press the whole sheet stack P2 to the position which is shown as accommodating the sheet stack P1 on the first tray 20. Since the pressing portions 41*a* protrude more to the front than the lower end 41*b* which is located below the bottom plate 10 with respect to the direction of sheet shift, they can shift the sheet stack P2 to the position of the sheet stack P1.

The back fence 41 is moved in a reciprocating motion by the reversible motor 48 and accommodated in the second tray 21 together with the pulleys 44–47. Therefore, when the tray 21 is pulled out from the copier, it is accompanied by the back fence 41, wire 43, and pulleys 44–47, as shows in FIG. 5. When the tray 21 is inserted into the copier body, connectors, not shown, each being provided on respective one of the copier body and tray are coupled to power the motor 48 and sensors 49 and 50. Considering safety standards, it is preferable to provide a shutter which closes the connector of the copier body in interlock relation to the pull-out of the tray 21.

Figures 6, 6A:
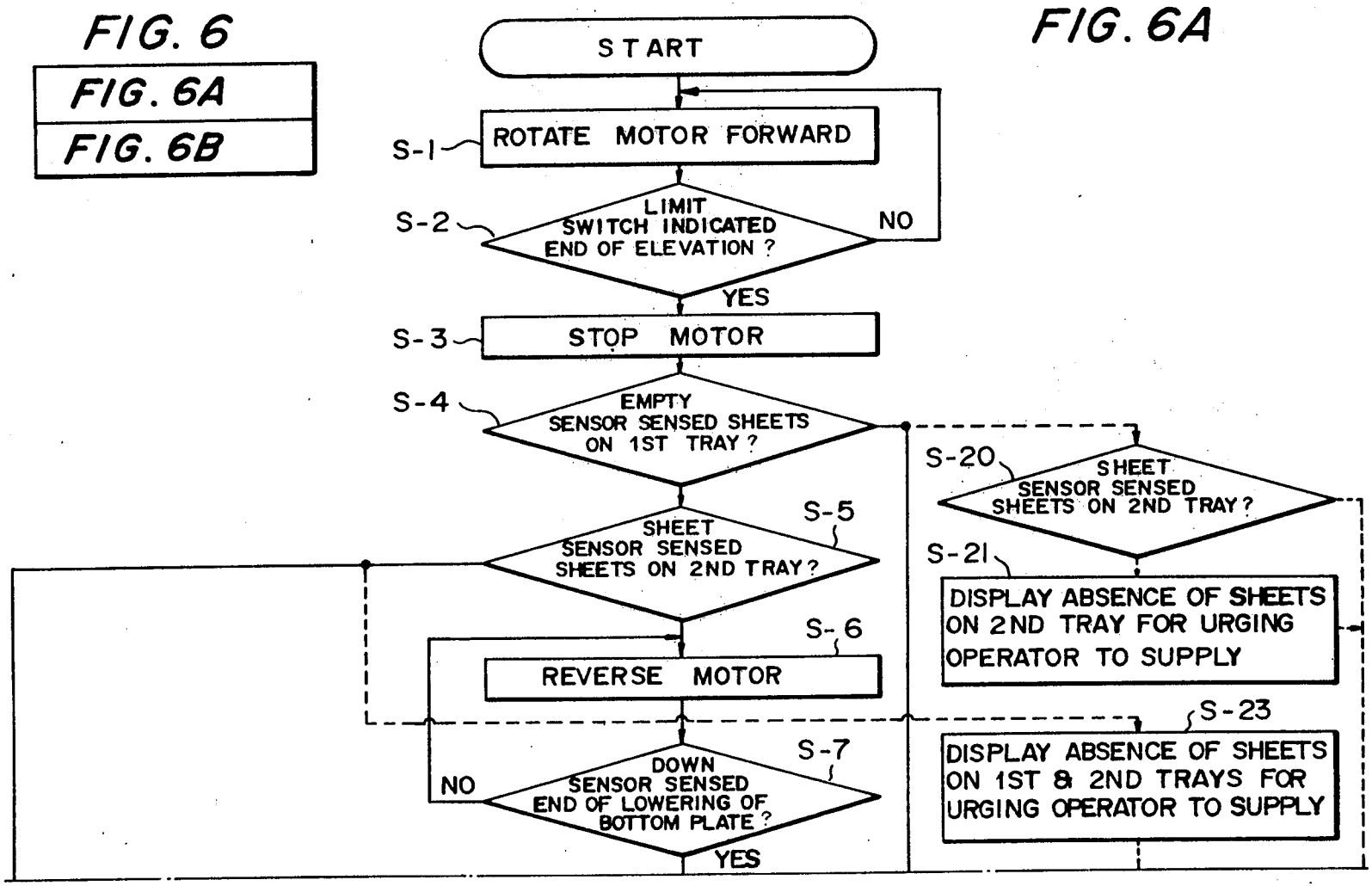
FIG. 6 including
FIGS. 6A and 6B is a flowchart demonstrating a specific operation of the embodiment.
Figure 6B:
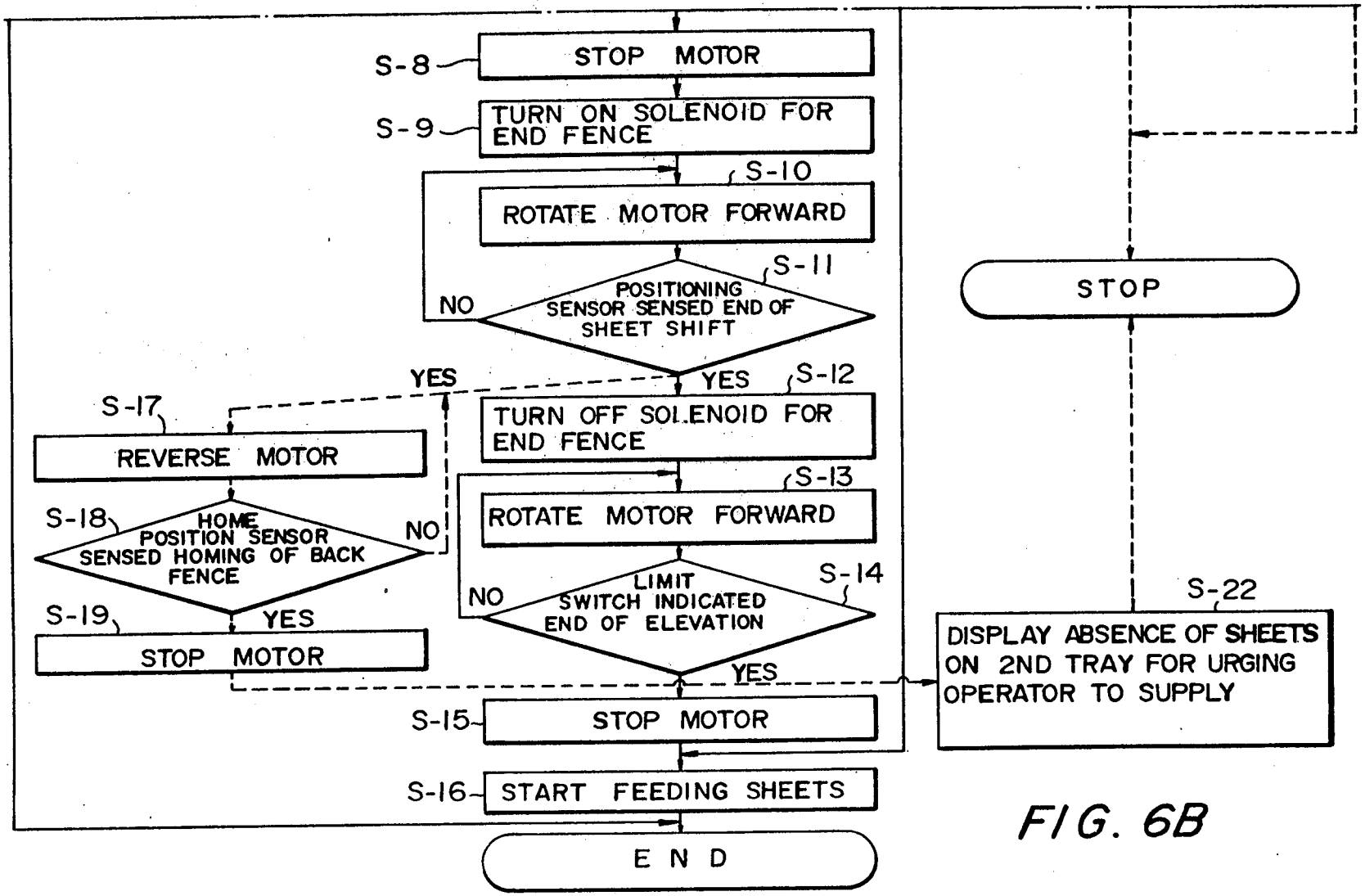

The operation of the illustrative embodiment will be described with reference to FIG. 6. In FIG. 6, dashed lines are indicative of parallel processing to be executed by arithmetic and logical unit, not shown.

Before the feed of a sheet, the reversible motor 54 is rotated in the forward direction to raise the bottom plate 37 of the first tray 20 (step S-1). As the limit switch 55 determines that the elevation of the bottom plate 37 has completed (YES, S-2), the motor 54 is deenergized (S-3). The empty sensor 57 determines whether or not the sheets P1 are present on the tray 20 (S-4) and, if they are absent (NO, S-4), the sheet sensor 51 determines whether or not the sheets P2 are present on the tray 21 (S-5). If the answer of the step S-5 is positive, the motor 54 is reversed to lower the bottom plate 37 of the first tray 20 (S-6). As soon as the down sensor 56 determines that the bottom plate 37 has been fully lowered (YES, S-7), the motor 54 is deenergized (S-8) and the solenoid 38 is energized (S-9) to move the back fence 36 of the tray 20 out of the shift path 25. Then, the reversible motor 48 is rotated forward to move the back fence 41 of the second tray 21 with the result that the sheet stack P2 is shifted to the first tray 20 (S-10). When the positioning sensor 50 senses the lug 41c of the back fence 41, it is determined that the shift of the sheet stack P2 has ended (YES, S-11). As a result, the solenoid 38 is deenergized (S-12) to return the back fence 36 of the first tray 20 to the original position. Subsequently, the motor 54 is rotated forward to raise the bottom plate 37 of the first tray 20 (S-13). As the limit switch 55 determines that the bottom plate 37 has been fully raised (YES, S-14), the motor 54 is deenergized (S-15) and an operation for feeding the sheets begins (S-16).

If the shift of the sheet stack P2 has ended as determined in the step S-11, the motor 48 is reversed (S-17). As the home position sensor 49 senses the lug 41c of the back fence 41, it is determined that the back fence 41 has returned to the home position thereof (YES, S-18). Then, the motor 48 is deenergized (S-19).

In the paper sheets P1 are present as determined in the step S-4, the sensor 51 determines whether or not the paper sheets P2 are present on the tray 21 (S-20). If the answer of the step S-20 is negative, an operating section, not shown, displays the absence of the paper sheets P2 on the tray 21 to urge the operator to supply paper sheets (S-21). When the shift of the paper sheets P2 to the tray 20 has ended, the operating sections also displays that the paper sheets P2 are absent (S-22), as in the step S-21. Further, when the paper sheets P2 are absent on the tray 21 as determined in the step S-5, the operating section informs the operator of the absence of the paper sheets P1 and P2 on the trays 20 and 21 and thereby urges the operator to supply sheets (S-23).

Figure 5:
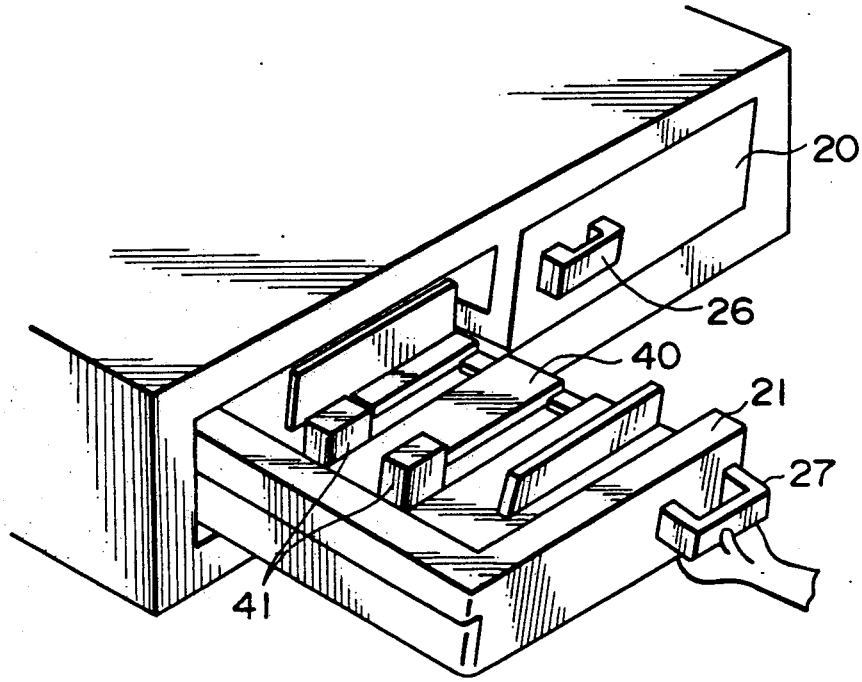
FIG. 5 is a perspective view showing one of trays included in the embodiment in a positioned pulled out from the copier body.

On noticing the display indicative of the absence of the sheets P2 on the tray 21 (S-21 or S-22), the operator can readily supply sheets by pulling the knob 27 of the tray 21 toward the operator, as illustrated in FIG. 5. Even when the feed of sheets from the tray 20 is under way, sheets can be supplied to the tray 21 to eliminate a time loss. When the trays 20 and 21 have run out of the sheets P1 and P2, respectively, as determined in the step S-23, the operator can load the trays 20 and 21 with supplementary sheets by pulling the knobs 26 and 27 of the trays 20 and 21.

In an alternative embodiment of the present invention which is not shown specifically, the first tray 20 is affixed to the copier body while the second tray 21 is movable out of the copier body. Although such an arrangement reduces the amount of sheets which can be supplied by a single operation, it allows sheet to be supplemented while a sheet feed operation is under way. The alternative embodiment is as easy as the previous embodiment regarding the supply of sheets to the second tray 21. In addition, the omission of the mechanism for pulling out the first tray 20 contributes to the cut-down of cost.

Figure 7:
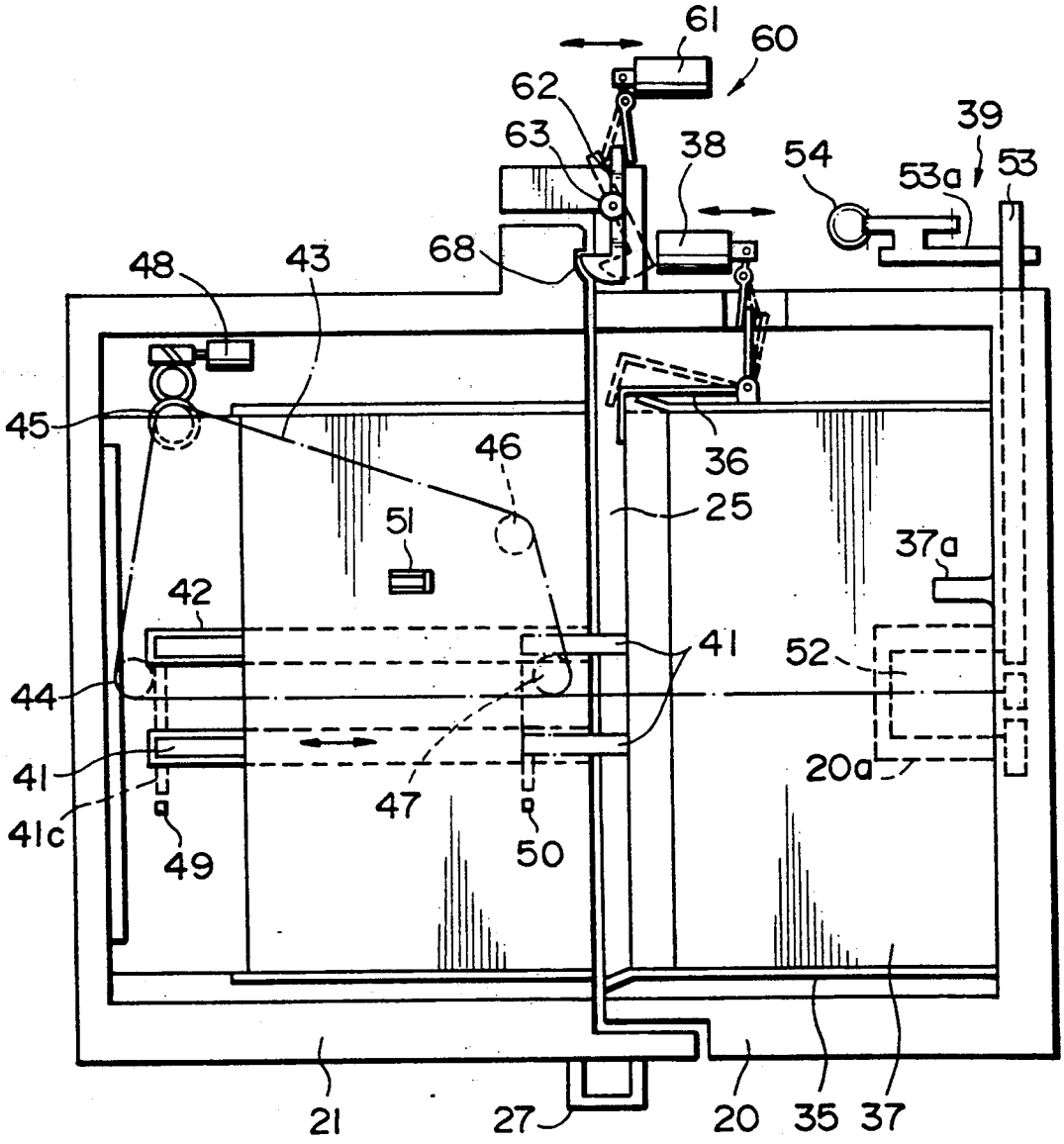
FIG. 7 is a fragmentary plan view showing an alternative embodiment of the present invention.

Referring to FIG. 7, another alternative embodiment of the present invention is shown. In FIG. 7, the same parts and structural elements as those shown in FIG. 2 are designated by like reference numerals, and redundant description will be avoided for simplicity. This embodiment is characterized in that locking means 60 is provided, and in that only the second tray 21 has the knob 27.

Figure 8:
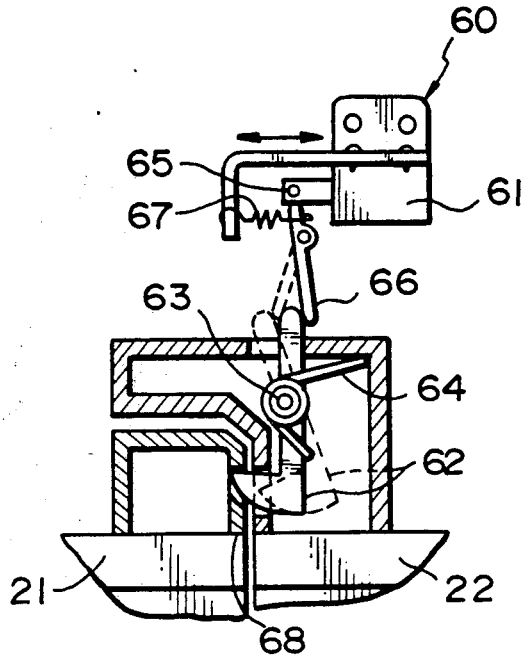
FIGS. 8 and 9 are views showing the construction and operation of locking means.
Figure 9:
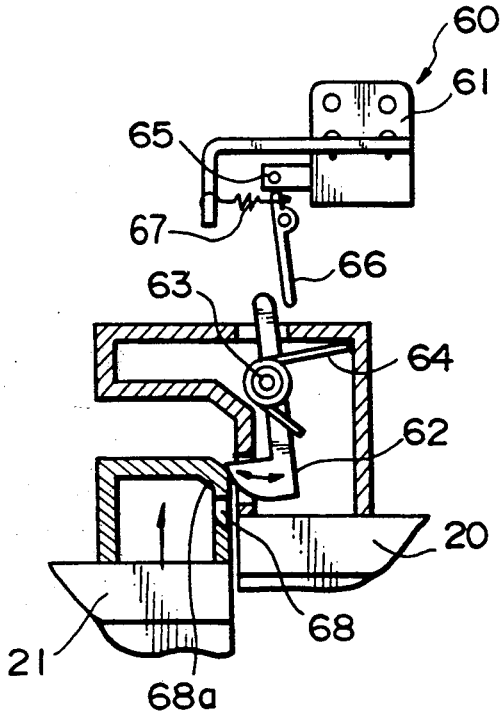

FIGS. 8 and 9 shows the locking means 60 in detail. As shown in FIGS. 7 through 9, the locking means 60 has an unlock solenoid 61, a lock pawl 62 rotatably mounted on a shaft 63 which is affixed to part of the first tray 20, a torsion spring 64 constantly biasing the lock pawl 62 clockwise, a lever 65 for operating the unlock solenoid 61, a rotatable lever 66 connected to the lever 65 by a return spring 67 and abutting against the lock pawl 62 at one end thereof, and a notch 68 formed in the second tray 21 for receiving the lock pawl 62.

As shown in FIG. 8, the free end of the lock pawl 62 is received in the notch 68 of the second tray 21. In this condition, as the operator pulls out the second tray 21, the first tray 20 is pulled out together with the second tray 21. When the unlock solenoid 61 is energized, it rotates the lever 66 to a position indicated by a phantom line in the figure against the action of the return spring 67. Then, the free end of the lock pawl 62 is released from the notch 68 of the second tray 21 with the result that the first tray 20 is not entrained by the second tray 21.

FIG. 9 shows a condition wherein the second tray 21 is inserted into the copier body while the unlock solenoid 61 is not energized. The upper end 68a of the notch 68 as viewed in the figure is so shaped as to rotate the free end of the lock pawl 62 counterclockwise. Hence, in the condition shown in FIG. 9, the lock pawl 62 is rotated against the action of the torsion spring 64 to allow the tray 21 to enter the copier body.

Figures 10, 10A:
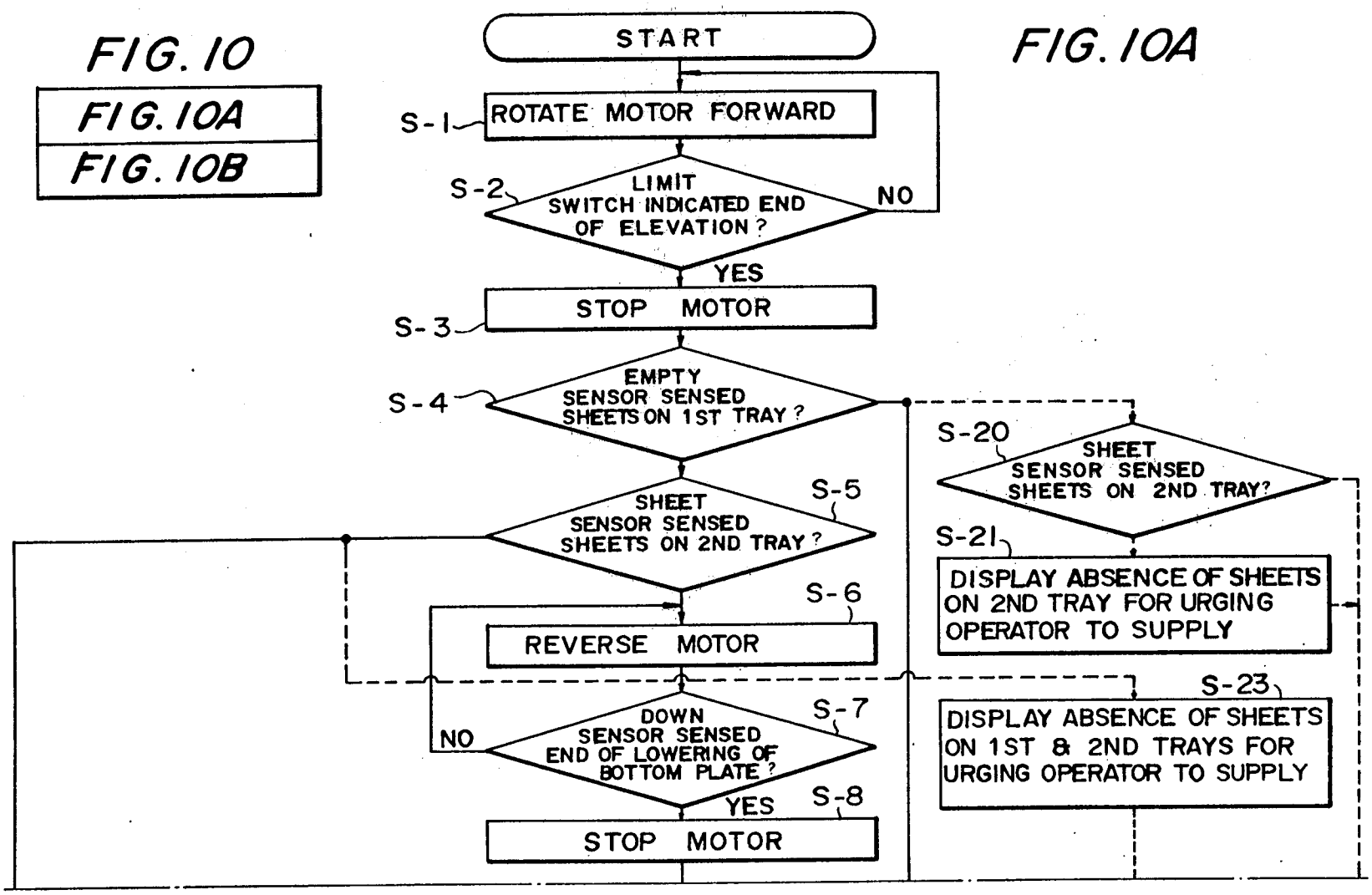
FIG. 10 including
FIGS. 10A and 10B is a flowchart representative of a specific operation of the alternative embodiment.
Figure 10B:
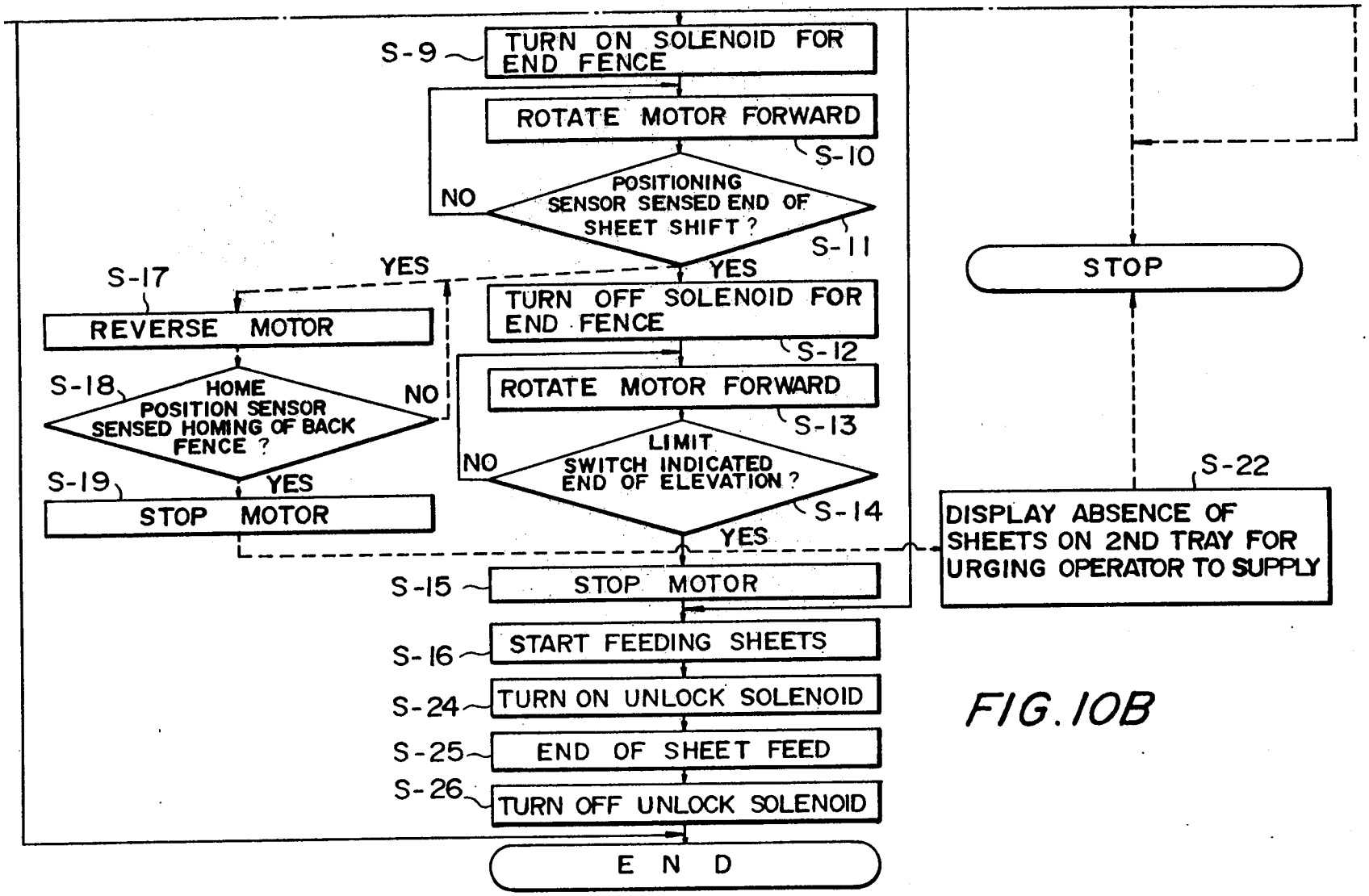
Figure 11:
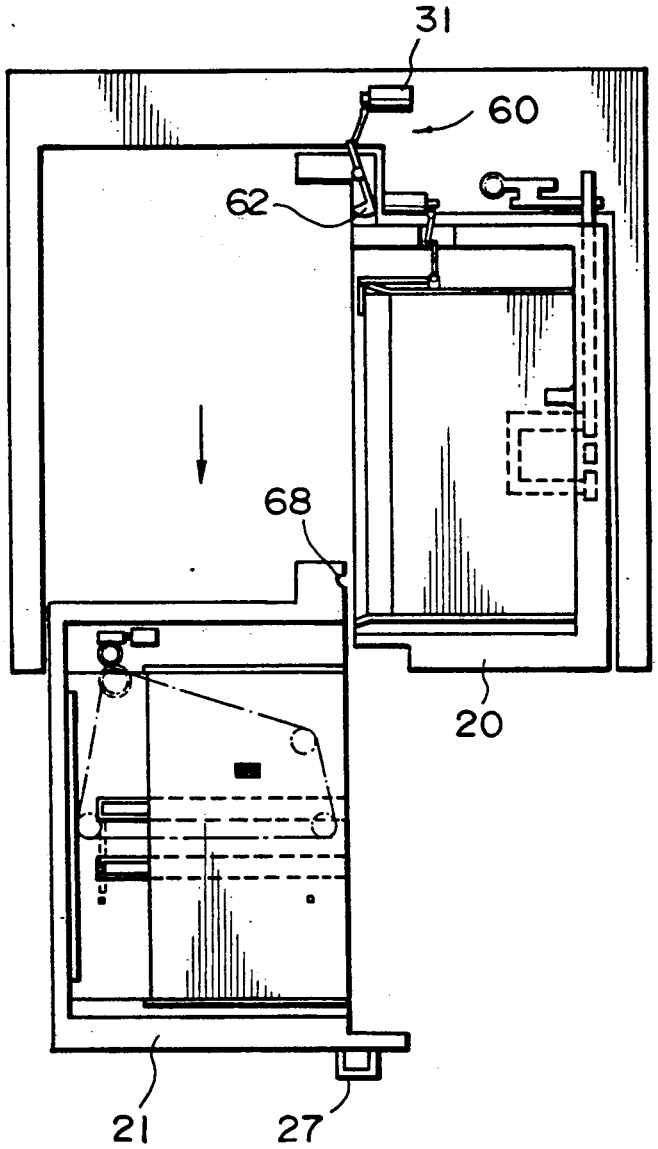
FIGS. 11 and 12 are plan views each showing trays included in the alternative embodiment in a particular condition.
Figure 12:
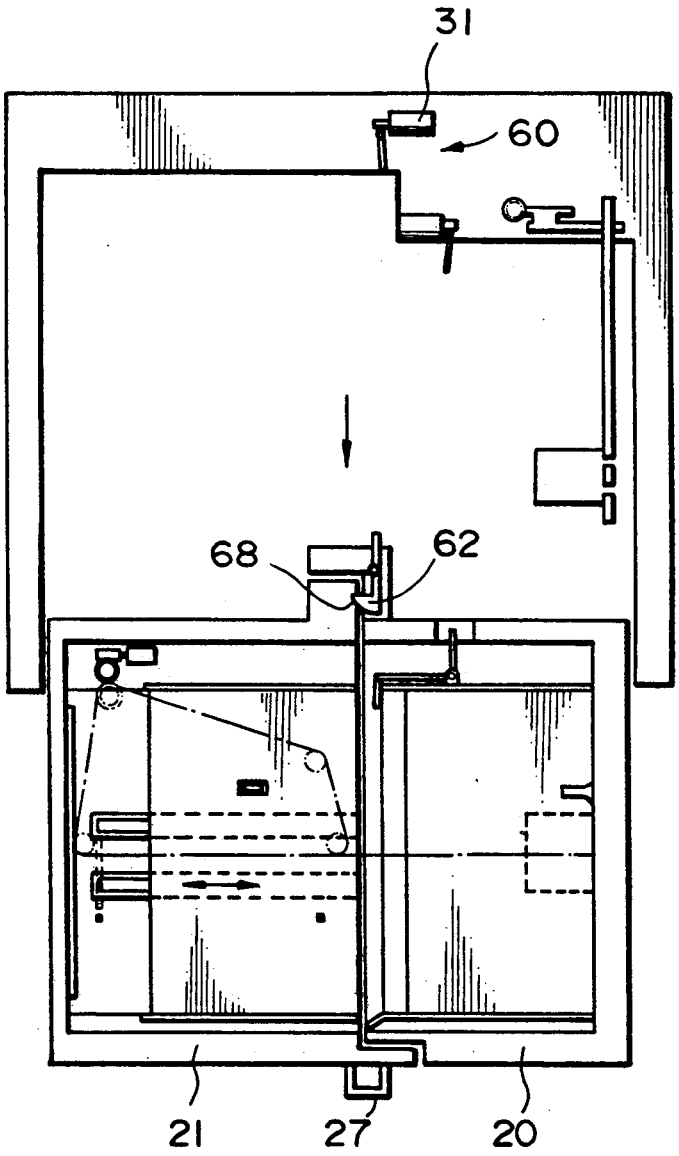

The operation of this embodiment will be described with reference to FIG. 10. The steps S-1 to S-23 shown in FIG. 10 are the same as those shown in FIG. 6. On the start of the sheet feed operation, the unlock solenoid 61 is energized (S-24) to unlock the first and second trays 20 and 21 from each other. In this condition, as the operator pulls the knob 27 of the second tray 21 toward the operator, only the tray 21 moves out of the copier body, as shown in FIG. 11. Then, the operator can put a supplementary stack of sheets on the tray 21. As the sheet feed operation completes (S-25), the unlock solenoid 61 is deenergized (S-26). In this condition, when the operator pulls the knob 27 of the second tray 21, both of the trays 20 and 21 move out of the copier body, as shown in FIG. 12.

As stated above, when the operator pulls the knob 27, the machine itself determines whether only the tray 21 should be pulled out or whether both of the trays 20 and 21 should be pulled out. The operator, therefore, can supply sheets to a tray of interest with assurance. To prevent the operator from pulling out the tray while the shift of the sheet stack P2 from the tray 21 to the tray 20 is under way, the embodiment may be further provided with a mechanism which prevents either one of the trays 20 and 21 from being pulled out from the copier body.

Figure 13:
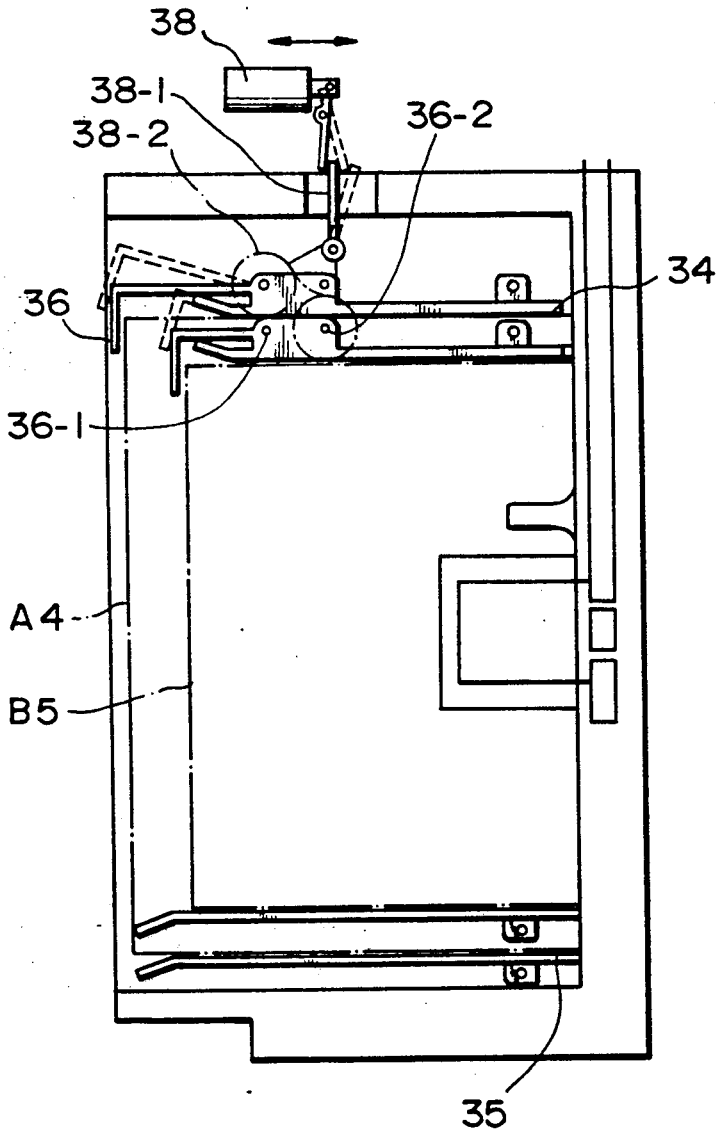
FIG. 13 is a fragmentary plan view showing another alternative embodiment of the present invention.

As shown in FIG. 13, the side fences 34 and 35 may be repositioned in the widthwise direction of the sheets in matching relation to the size of the sheets. In the specific configuration shown in FIG. 13, screw holes are formed through the first tray 20 to allow the side fences 34 and 35 to be so repositioned on the tray 20. Alternatively, the side fences 34 and 35 may be moved by a belt drive to an adequate position matching a particular sheet size. The back fence 36 is rotatable about part of the side fence 36. The side fence 34 is formed with two engaging portions 36-1 and 36-2, so that the back fence 36 may be engaged with one of the engaging portions 36-1 and 36-2 which matches the sheet size. A solenoid 38 is mounted on the copier body for driving a gear 38-2 via a sector gear 38-1 having an arm. In this configuration, the stroke of the solenoid 38 is transmitted to the drive gear 38-2 to move the back fence 36 out of the sheet transport area.

Figure 14:
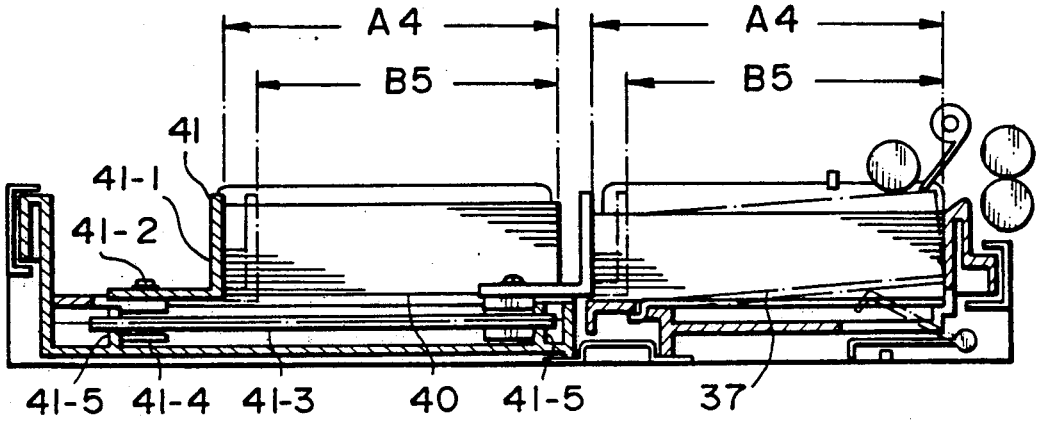
FIG. 14 is a plan view showing another alternative embodiment of the present invention.

As shown in FIG. 14, the movable back fence 41 may be connected at an engaging portion 41-2 thereof to a slider 41-4. The slider 41-4 is movable linearly along a guide rod 41-3 which is affixed to the second tray 21. The back fence 41 can adapt itself to any sheet size if the position where it is connected to the slider 41-4 is changed. To promote easy movement of the sheet stacks, the bottom plates 37 and 40 have their surfaces smoothed and/or are provided with ribs and beads. The previously mentioned slots 42, FIGS. 2 and 7, are formed through the bottom plate 40 which is affixed to the second tray 21, so that the pressing portions 41-1 of the back fence may be movable therealong. Since the pressing portions 41-1 are positioned more to the front than the engaging portion 41-2, they can shift the sheet stack P2 to the position where the sheet stack P1 is located.

Figure 15:
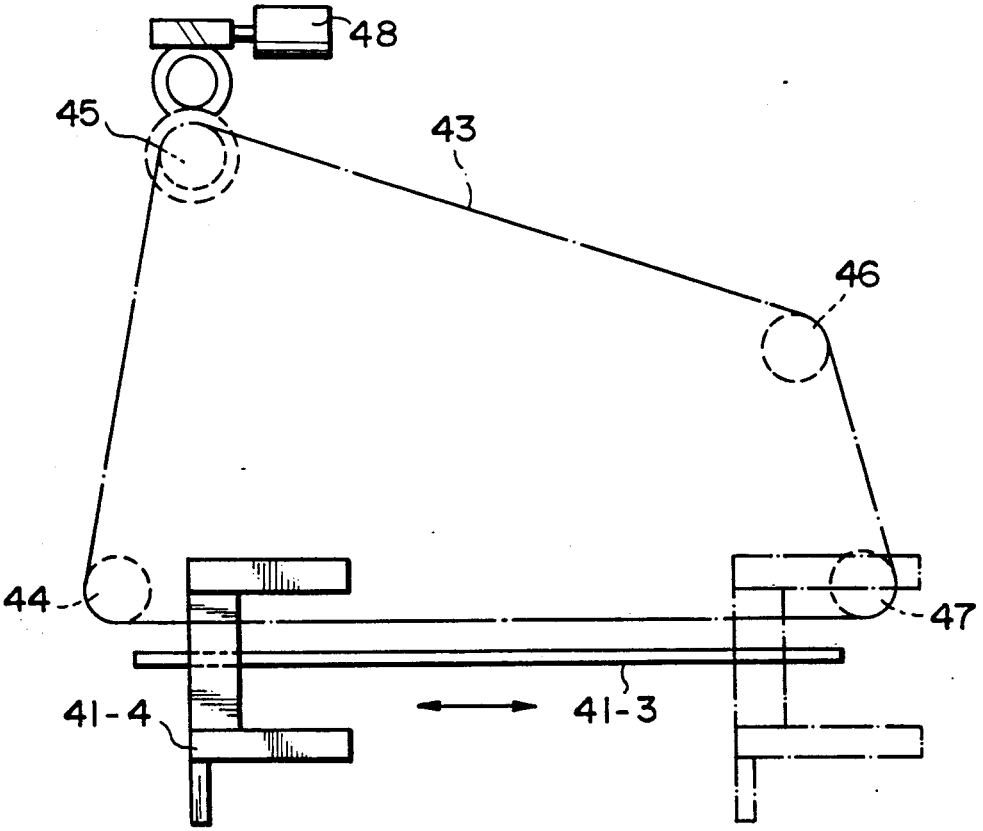
FIG. 15 shows a slider drive section in detail.

FIG. 15 shows a specific arrangement for causing the slider 41-4 to move back and forth along a linear path. As shown, the slider 41-4 is affixed to the wire or timing belt 43 which is passed over the pulleys 44, 45, 46 and 47. The reversible motor 48 reversibly rotates the pulley 45 to thereby move the back fence 41 back and forth.

Figure 16:
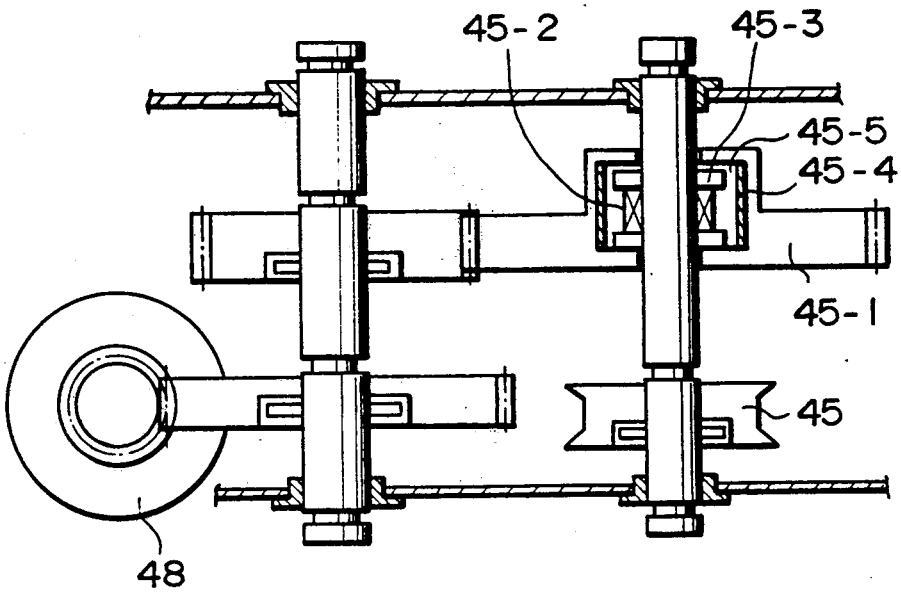
FIG. 16 shows a pulley in detail.
Figure 17:
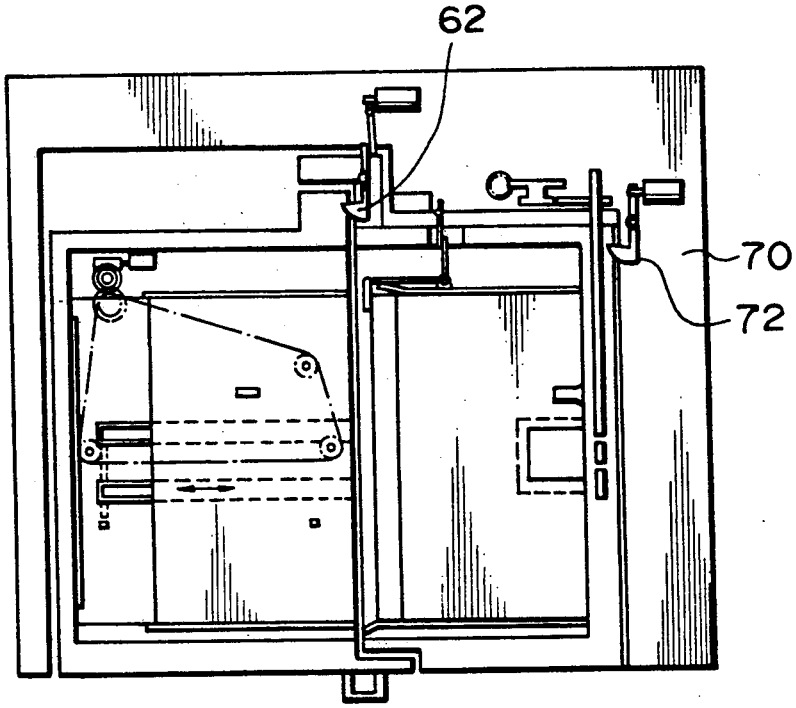
FIG. 17 is a plan view showing another alternative embodiment of the present invention including a first and a second locking mechanism.

FIG. 16 shows the pulley 45 in detail. As shown, the pulley 45 and a torque limiter 45-1 with a gear are coaxially mounted on a shaft. The torque limiter 45-1 transmits the torque of the motor 48 to the pulley 45 while limiting it to above a predetermined value. In the specific arrangement shown in FIG. 16, the torque limiter 45-1 has a permanent magnet 45-2, and a metallic disk 45-3 and a metallic drum 45-4 which are magnetic bodies. The permanent magnet 45-2 causes magnetic powder 45-5 to gather in the small gap between the disk 45-3 and the drum 45-5 to thereby produce a magnetic flux. As a result, the torque of the motor 48 is transmitted to the pulley 45. When a torque higher than a predetermined one acts on the torque limiter 45-1, the magnetic powder 45-5 and the drum 45-4 slip on each other. The output torque of the torque limiter 45-1 is selected to be greater than the load for causing the back fence 41 to shift the sheet stack and smaller than the maximum output torque of the motor 48. Hence, when the sheet stack being shifted by the back fence 41 is caught or when the slider 41-4 abuts against a stop 41-5, torque limiter 45-1 simply idles to prevent the drive section from being damaged by the resultant excessive load.

The home sensor 49 and positioning sensor 50 each senses the lug 41c of the back fence 41 to turn on or turn off the reversible motor 48 so as to position the back fence 41, as stated earlier. While the motor 48 may be implemented as a stepping motor, it is advantageously implemented as a DC motor from the cost standpoint although it involves a great overrun. In light of this, as shown in FIG. 14, the stop 41-5 is used to limit the movable range of the slider 41-4, and the back fence 41 in reciprocating movement is positioned when the slider 41-4 abuts against the stop 41-5.

Both of the back fence arrangement and the back fence drive arrangement described above are accommodated in the box-like second tray 21. Hence, when the tray 21 is pulled out of the copier body, it is accompanied by such arrangements, as shown in FIGS. 7 and 8. When the tray 21 is inserted into the copier body, connectors provided on the copier body and tray 21 are coupled together to power the motor 48 and sensors 49 and 50. A shutter for closing the connector of the copier body is desirable from the safety standpoint, as stated earlier.

In summary, in accordance with the present invention, a first sheet storing section is implemented as a single tray which can be pulled out toward the operator along guide rails. Since the first storing section accommodates a great amount of sheets, it reduces the overall thickness of the sheet feeding device and allows sheets to be supplemented and fed out without interruption.

When both of a first and second sheet storing section are implemented as a tray which can be pulled out along guide rails, a great amount of sheets can be loaded in two stacks on the two trays. This is also successful in reducing the thickness of a sheet feeding device and allowing sheets to be supplied and fed out without interruption.

At least one of the two trays is provided with a portion which can be pulled by hand toward the operator. This facilitates the pull-out of the tray or trays from the copier body.

Sheet shifting means has a pressing plate which is supported by a guide member in such a manner as to be movable back and forth and operatively connected to a drive section via a torque limiter. Such sheet shifting means automatically shifts a sheet stack from one tray to the other tray while safeguarding the drive section against damage otherwise caused by loads greater than a predetermined one.

Since the drive section is connected to the pressing plate via the torque limiter, the drive section itself is protected from damage eve when a load greater than a predetermined one acts thereon during the shift of a sheet stack.

The torque of the torque limiter is selected to be greater than the load torque necessary for the shift of a sheet stack from one tray to the other tray and smaller than the allowable torque of a reversible motor which is a drive source. Therefore, when a sheet stack being shifted from one tray to the other tray jams, the torque limiter simply idles to prevent the drive section from being damaged.

The sheet shifting means is provided with a sensor responsive to the pressing plate having completed the shift of a sheet stack from one tray to the other tray. Therefore, the drive source is automatically deenergized when the shift of a sheet stack is completed.

When the sensor responsive to the pressing plate does not sense the pressing plate within a predetermined time after the start of the shift of a sheet stack from one tray, control means deenergizes the motor and displays a message for alerting the operator to a jam.

One of the trays is provided with a locking mechanism to be prevented from being pulled out from the copier body. This prevents the operator from inadvertently pulling out such a tray from the copier body.

The sheet feeding device may be provided with a first locking mechanism which locks the two trays to each other, and a second locking mechanism which prevents the two trays from being pulled out from the copier body. The first locking mechanism allows both of the trays to be pulled out and inserted into the copier body at the same time. The second locking mechanism prevents the operator from inadvertently pulling out both of the trays.

Control means maintains the lock mechanism or mechanisms active until a sheet stack has been fully shifted from one tray to the other tray. This prevents the operator from pulling out the tray while the shift of a sheet stack is under way.

The pressing plate is removably mounted on the slider by support means and, therefore, can be removed with ease.

Repositioning means allows the pressing plate to be changed in position on the support means in matching relation to the size of sheets.

At least one back fence positions the rear end of a sheet stack accommodated in one tray. Side fences are capable of supporting the back fence rotatably at any of a plurality of positions and positions the sheet stack in the lateral direction. Hence, the position of the back fence can be changed to accommodate sheets of any size in the single tray.

Back fence drive means has a solenoid for actuating the back fence and causes the back fence to retract from a sheet shift zone when a sheet stack is shifted from one tray to the other tray. The back fence is, therefore, prevented from contacting a sheet to an excessive degree, i.e., from damaging the sheet stack.

The second storing section has a sensor responsive to sheets present therein. When the sensor determines that sheets are absent in the second storing section, control means displays the empty state of the storing section to urge the operator to supply sheets to the storing section of interest.

Various modifications will become possible for those skilled in the art after receiving the teachings of the present disclosure without departing from the scope thereof.

What is claimed is:

1. A sheet feeding device for image forming equipment, comprising:

first storing means for stacking a plurality of sheets;

feeding means for feeding sheets one by one from said first storing means;

second storing means positioned horizontally and parallel to said first storing means;

shifting means for shifting sheets collectively from said second storing means to said first storing means; and guide means for guiding said second storing means such that said second storing means may be pulled out in a direction substantially perpendicular to an intended direction of sheet shift.

2. A device as claimed in claim 1, further comprising:

sensor for sensing sheets stacked on said second storing means; and means for displaying, when said sensor does not sense sheets, information representative of an empty state.

3. The sheet feeding device of claim 1, wherein said guiding means includes guides for guiding the second storing means without moving the first storing means.

4. The sheet feeding device of claim 1, further including coupling means for selectively coupling and uncoupling said first and second storing means, such that in the coupled condition said first storing means moves with said second storing means along said guide means, and in said uncoupled condition said second storing means can be moved along said guide means without moving said first storing means.

5. A device as claimed in claim 1, wherein said first storing means and said second storing means comprise a first tray and second tray, respectively.

6. A device as claimed in claim 5, wherein said guide means comprises a first and a second guide rail guiding said first tray and said second tray, respectively.

7. A device as claimed in claim 5, wherein at least one of said first and second trays comprises means for allowing said tray to be pulled out by hand.

8. A device as claimed in claim 5, wherein said shifting means comprises:

a pressing plate for shifting a stack of sheets loaded on said second tray to said first tray by pressing substantially the center of the rear end of said stack;

a guide member affixed to said second tray for causing said pressing plate to move back and forth in said intended direction of sheet shift; and drive means for driving said pressing plate in a reciprocating motion along said guide member.

9. A device as claimed in claim 8, wherein said drive means comprises a reversible motor.

10. A device as claimed in claim 9, wherein said drive means is drivably connected to said pressing plate via torque limiter means which transmits a predetermined torque.

11. A device as claimed in claim 10, wherein said torque which said torque limiter means transmits is selected to be greater than a load torque for shifting a stack of sheets from said second tray to said first tray and smaller than an allowable torque of said reversible motor.

12. A device as claimed in claim 8, wherein said shifting means further comprises a sensor responsive to said pressing plate having completed the shift of a stack of sheets from said second tray to said first tray.

13. A device as claimed in claim 12, further comprising means for deenergizing, when said sensor does not sense said pressing plate within a predetermined period of time after said pressing plate has started shifting a stack of sheets from said second tray, said reversible motor and displaying information representative of a jam having occurred during a shift.

14. A device as claimed in claim 8, further comprising a support member on which said pressing member is removably mounted.

15. A device as claimed in claim 14, further comprising repositioning means for changing the position where said pressing plate is mounted on said support member in said intended direction of sheet shift.

16. A device as claimed in claim 5, further comprising locking means for preventing said second tray from being pulled out from a body of said device.

17. A device as claimed in claim 16, further comprising control means for maintaining said locking means active until the shift of a stack of sheets from said second tray to said first tray completes.

18. A device as claimed in claim 5, further comprising first locking means for locking said first and second trays to each other, and second locking means for preventing said first and second trays from being pulled out from a body of said device.

19. A device as claimed in claim 18, further comprising control means for maintaining said locking means active until the shift of a stack of sheets from said second tray to said first tray completes.

20. A device as claimed in claim 5, further comprising:

at least one back fence for positioning the rear end of a stack of sheets accommodating in said second tray; and side fences supporting said back fence rotatable at any of a plurality of positions and positioning said stack of sheets accommodated in said second tray in a direction perpendicular to said intended direction of sheet shift.

21. A device as claimed in claim 20, further comprising back fence drive means for causing said back fence to retract from a sheet shift zone during the shift of a stack of sheets from said second tray to said first tray.

* * * * *